US006276004B1

(12) United States Patent
Bertrand et al.

(10) Patent No.: US 6,276,004 B1
(45) Date of Patent: Aug. 21, 2001

(54) SHOWER ARM MOUNTING

(75) Inventors: John E. Bertrand, Avon; Michael A. Brattoli, Elyria, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/500,945

(22) Filed: Feb. 15, 2000

(51) Int. Cl.[7] ..... A47K 3/22

(52) U.S. Cl. ..... 4/615; 4/675; 4/567; 239/282; 137/359

(58) Field of Search ..... 4/615, 675, 678, 4/367; 137/359, 360, 801; 239/282, 283, 525, 273; 285/404, 282, 8, 46, 90, 136.1, 918; 277/602, 608, 609, 614, 625

(56) References Cited

U.S. PATENT DOCUMENTS

| | | | | |
|---|---|---|---|---|
| 238,300 | | 3/1881 | Mattullath . | |
| 1,597,477 | | 8/1926 | Panhorst . | |
| 1,665,436 | | 4/1928 | Bloch . | |
| 1,835,301 | | 12/1931 | Hennessey . | |
| 2,997,058 | | 8/1961 | Hall . | |
| 3,136,570 | * | 6/1964 | Lee | 137/360 |
| 3,371,679 | | 3/1968 | Minella . | |
| 3,392,746 | * | 7/1968 | Young | 137/360 |
| 3,564,621 | | 2/1971 | Fletcher . | |
| 3,640,305 | * | 2/1972 | Young | 137/360 |
| 3,971,401 | | 7/1976 | Persson . | |
| 4,463,460 | | 8/1984 | Arnold et al. . | |
| 4,823,409 | * | 4/1989 | Gaffney | 4/192 |
| 4,884,596 | * | 12/1989 | Byers et al. | 137/801 |
| 5,195,553 | | 3/1993 | Wright . | |
| 5,275,199 | | 1/1994 | Howell . | |
| 5,926,868 | * | 7/1999 | Bjerke | 4/675 |

* cited by examiner

*Primary Examiner*—Gregory L. Huson
*Assistant Examiner*—Huyen Le
(74) *Attorney, Agent, or Firm*—Cook, Alex, McFarron, Manzo, Cummings & Mehler, Ltd.

(57) ABSTRACT

A modular shower arm assembly for use in removably attaching a shower fixture to the unthreaded end of a pipe extending outwardly from a shower stall wall without affecting connection of the pipe to a water supply system behind the shower wall uses an adapter sleeve closely fitting over the pipe and located within a chamber in the shower arm water passage. There is a threaded fastener which extends from the top or upper surface of the shower arm, where it is normally unseen, to mount the sleeve and the shower arm to the pipe.

3 Claims, 1 Drawing Sheet

SHOWER ARM MOUNTING

THE FIELD OF THE INVENTION

The present invention relates to a modular shower arm construction in which the visible, exterior and/or decorative elements of a shower installation may be removed without affecting or disturbing the connection between the pipe which extends through the shower stall wall and the water supply. It is conventional in shower and bath installations for there to be a pipe which connects to the water supply and extends outwardly through the shower stall wall. This pipe is often threaded and a shower fixture is threaded onto the pipe. Most homeowners are reluctant to remove an existing shower fixture from the wall because of fear that in so doing they would break the connection between the pipe and the interior water supply connection which is behind the shower wall.

The present invention provides a mounting system for a shower fixture, such as a shower head, in which the decorative and exposed elements of the shower assembly, specifically the shower head, the shower arm and escutcheon if one is present, may be removed and replaced with elements of a different esthetic appearance without in any way affecting the behind-the-wall connection with the water supply. There is a pipe which extends outwardly through the shower stall wall from the water supply and this pipe may have a smooth, unthreaded end. A tubular shower arm, decorative in outer appearance, is mounted to the pipe through the use of an adapter sleeve. A set screw, which extends through aligned openings in the tubular shower arm and adapter sleeve, but is normally not visible to a user of the shower fixture, fixes the tubular shower arm and adapter sleeve on the unthreaded end of the pipe. The shower fixture is mounted to the exposed end of the tubular shower arm and the shower arm masks or covers the connection to the pipe extending outwardly from the shower stall wall.

SUMMARY OF THE INVENTION

The present invention relates to a modular shower arm assembly and more specifically to an assembly in which its decorative appearance may be changed and the elements of the assembly replaced without affecting the connection between the water supply and the pipe which extends outwardly through the shower stall wall.

Another purpose is to provide a reliable, simply constructed, shower assembly mounting system which provides for removal and replacement of the decorative elements associated with a shower fixture, without removing or affecting the tubular water conduit that extends outwardly from the shower stall wall.

Another purpose is a shower arm construction as described in which all decorative elements may be replaced from in front of the shower stall wall.

Another purpose is a modular shower arm assembly as described in which the attachment of the shower decorative elements to the shower stall wall pipe are normally hidden from view.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to a mounting system for shower fixtures, such as shower heads, but it can also have application to the mounting of bathtub spouts. More specifically, the invention pertains to a mounting system in which the visible, normally decorative, elements of a shower fixture installation may be removed and replaced in connection with changing the decor of a bathroom or lavatory without affecting the water supply pipe connection which is normally located behind the shower stall wall.

Most homeowners are reluctant to remove an existing shower fixture, as this usually dictates that the connecting pipe must be unscrewed from a fitting behind the shower wall. Homeowners usually prefer that this function be performed by a licensed plumber. The present invention provides a mounting system in which all of the decorative components may be replaced without in any way altering or removing the water supply pipe which protrudes through the shower stall wall and is connected to the water supply system behind the wall. The components of the mounting system are all positioned on the water supply pipe in a manner in which they may be simply and easily removed with normal hand tools. The components which provide the connection between the shower fixture and the pipe are normally hidden from view with the exception of a set screw which extends down through the top of the tubular shower arm through an opening which is normally not visible from someone using the shower fixture. The components forming the connection slide over the conventional copper pipe or "stubout" which extends through the shower stall wall.

Figure 1:
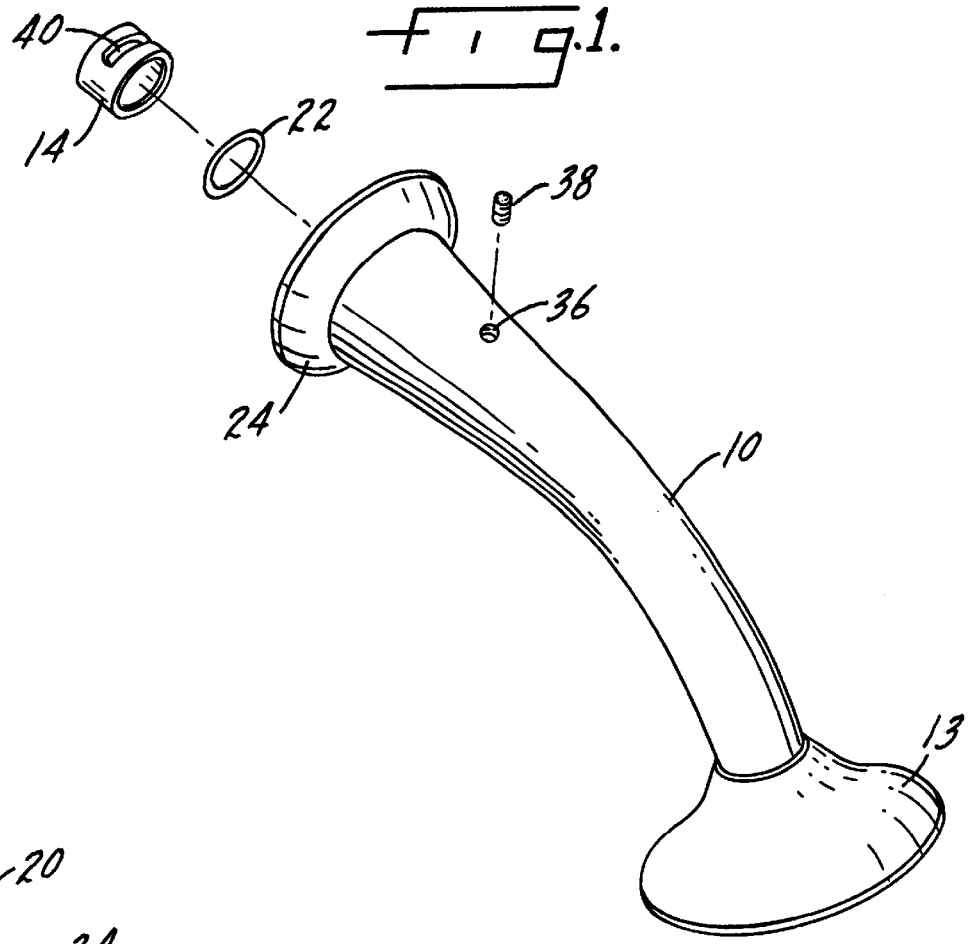
FIG. 1 is an exploded perspective of the modular shower arm assembly of the present invention.

In FIG. 1 the components forming the shower fixture installation include a tubular shower arm 10 having an exterior decorative appearance and a threaded end 12 for the mounting of a shower fixture such as a shower head 13. There is an adapter sleeve 14 which will form a portion of the connection between the tubular shower arm and the copper pipe 16 which extends through the front face 18 of the wall 20 of the shower stall. There is a seal ring 22 which will prevent water flowing through the tubular shower arm to the shower fixture from dripping out through the installation elements.

Figure 2:
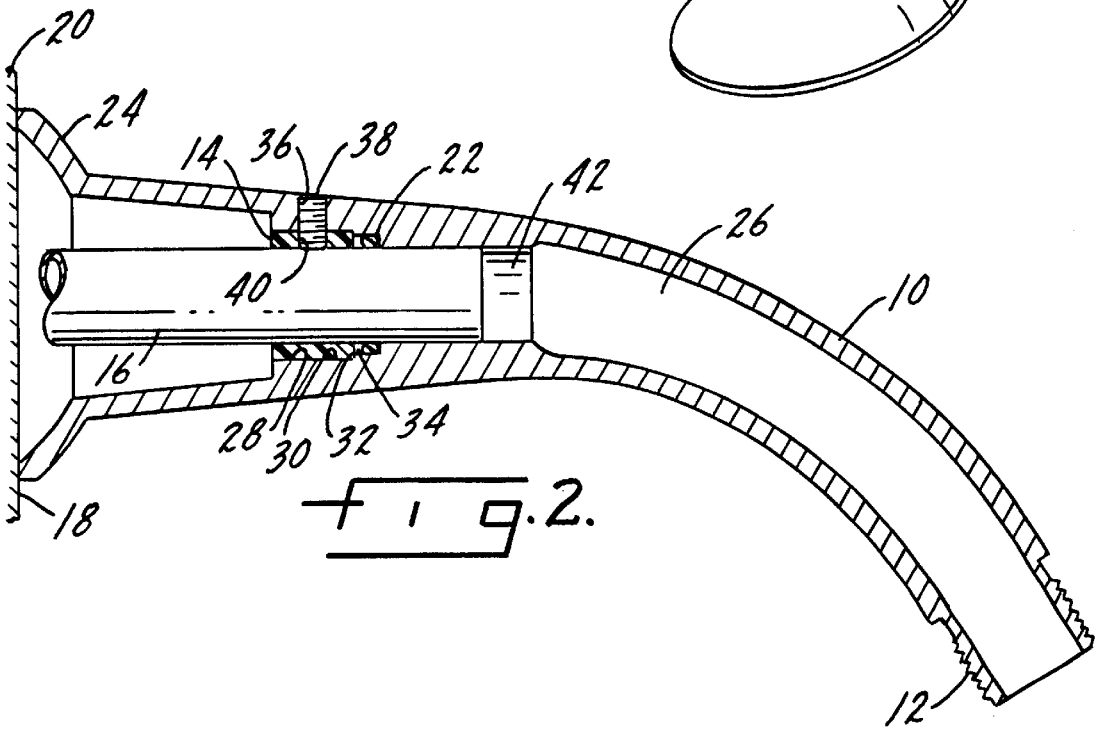
FIG. 2 is an axial section through the shower arm assembly of FIG. 1.

Focusing on FIG. 2, the tubular shower arm 10 has an enlarged curved surface 24 which may function as the escutcheon and which will bear against the surface 18 of the wall 20 when the shower installation is complete. There is a water passage 26 within the tubular shower arm for the flow of water to the shower fixture. The passage 26 includes a chamber 28 having a circumferential cylindrical wall 30 and a radially extending wall 32. The chamber 28 receives the adapter sleeve 14. The inner diameter of the adapter sleeve closely approximates the outer diameter of the pipe 16. This enables the sleeve 14 to be slid over the pipe, but yet to be fixed to the exterior of the pipe. Directly adjacent the chamber 28 is a second chamber 34 within which is positioned the seal ring 22. The ring 22 seals at its inner diameter to the pipe 16 and at its outer diameter to the chamber 34 forming a portion of the water passage of the tubular shower arm 10. The passage 26 has a portion 40 directly adjacent chamber 34 which is sized to closely fit on pipe 16.

The tubular shower arm has a threaded opening 36 within which will be threaded a set screw 38. The opening 36 for the set screw is at the top of the upper surface of the tubular shower arm where it is normally not visible to someone using the fixture. The sleeve 14 has an arcuate slot 40 through which the set screw 38 will pass when attaching the arm 10 to pipe 16.

In use, the first step in installation is to position the seal ring 22 within its chamber 34 in the tubular shower arm 10. Next, the adapter sleeve 14 is positioned within its chamber 28 so that the sleeve abuts the radial wall 32. The arcuate slot 40 in the adapter sleeve 14 should be positioned in alignment with the opening 36 in the tubular shower arm. The set screw is then inserted to hold the seal ring and sleeve within the shower arm. This combination of elements is then slid onto pipe 16 and moved inwardly onto the pipe until the escutcheon portion 24 of the tubular shower arm abuts the surface 18 of the wall 20. The set screw 38 may then be turned down until it bites into the outer surface of the copper pipe 16. This completes the installation.

If it is desired to change the shower arm and the shower head or fixture, the first step is to remove the shower head from the threaded connection 12 on the tubular shower arm 10. This may not be necessary if the shower head is to be changed. Next, the set screw 38 is backed off, permitting removal of the shower arm 10, the seal ring 22 and the adapter sleeve 14 from the copper pipe 16. This combination of elements may then be changed to one of a different exterior appearance and the assembly process is then followed to install the new fixture.

Whereas the preferred form of the invention has been shown and described herein, it should be realized that there may be many modifications, substitutions and alterations thereto.

The embodiments of the invention in which an exclusive property or privilege is claimed are defined as follows:

1. A modular shower arm assembly for use in removably attaching a shower fixture to an unthreaded end of a pipe extending outwardly from a shower wall without affecting connection of the pipe to a water supply system behind the shower wall, said shower arm assembly including:

a tubular shower arm adapted on one end thereof to mount a shower fixture, an adapter sleeve having an internal diameter adapted to provide a close, but sliding, fit on said pipe;

said tubular shower arm having an internal water passage which includes a chamber sized to closely fit about the adapter sleeve exterior diameter and to locate the sleeve positively relative to the shower arm;

a seal member located within said passage adjacent said adapter sleeve and in sealing contact with said passage and adapted to be in sealing contact with said pipe; and a threaded opening in said tubular shower arm on an upper exterior surface thereof, an arcuate slot in said adapter sleeve in alignment with said shower arm opening, a threaded fastener extending through said opening and slot and adapted to fix said shower arm and sleeve to said pipe.

2. The modular shower arm assembly of claim 1 wherein said water passage chamber has an interior circumferential cylindrical wall and an adjacent radial wall, defining an end of said chamber, with said adapter sleeve being sized to fit against both said circumferential cylindrical wall and said radial wall when positioned within said chamber.

3. The modular shower arm assembly of claim 1 wherein said shower arm water passage has a second chamber, directly adjacent the chamber for said adapter sleeve, with said seal ring being positioned within said second chamber, and said second chamber being downstream of said sleeve chamber.

* * * * *